US006142813A

United States Patent [19]

Cummings et al.

[11] Patent Number: 6,142,813

[45] Date of Patent: Nov. 7, 2000

[54] ELECTRICAL CONNECTOR ASSEMBLY

[75] Inventors: Douglas Cummings, Cortland; Michael De Angelis, Warren, both of Ohio

[73] Assignee: Delphi Technologies, Inc., Troy, Mich.

[21] Appl. No.: 09/207,865

[22] Filed: Dec. 8, 1998

[51] Int. Cl.[7] ..... H01R 13/64

[52] U.S. Cl. ..... 439/374; 439/357

[58] Field of Search ..... 439/374, 353, 439/354, 357, 717, 715, 712

[56] References Cited

U.S. PATENT DOCUMENTS 5,487,678 1/1996 Tsuji et al. ..... 439/353

5,988,511 11/1999 Schmidt et al. ..... 439/717

*Primary Examiner*—Paula Bradley

*Assistant Examiner*—Antoine Ngandjui

*Attorney, Agent, or Firm*—Richard A. Jones

[57] ABSTRACT

An electrical connector assembly includes a first connector having an alignment member extending outwardly from the first connector and having an aperture extending vertically therethrough. The first connector also includes a locking mechanism disposed within the alignment member. A second connector is interconnected with the first connector and includes a connector receiving cavity for cooperatively receiving the first connector. The second connector includes an alignment channel extending vertically along an inside surface of the connector receiving cavity for cooperatively receiving the alignment member. The second connector also includes a lock stop positioned within the alignment channel for cooperatively engaging with the locking mechanism to lock the first connector into the second connector.

16 Claims, 2 Drawing Sheets

ELECTRICAL CONNECTOR ASSEMBLY

BACKGROUND OF THE INVENTION

1. Field of the Invention

The present invention relates generally to electrical connectors and, more particularly, to a nested electrical connector assembly.

2. Description of the Related Art

An electrical connector is frequently used in conjunction with an electrical system on a vehicle and, in particular, a motor vehicle. The electrical connector is commonly used to interconnect one electrical component with another electrical component. In a similar manner, electrical connectors from multiple electrical components can be joined in an assembly, so that the assembly mates with an electrical connector from yet another electrical component. For example, in an in-line connector, two electrical connectors may be interconnected, such that one connector is disposed or nested within the other connector. Another common type of electrical connector is a modular connector.

A characteristic of an in-line electrical connector is that specific orientation is required to interconnect one connector with another connector. Another characteristic is that the locking portion of the electrical connector may be subject to damage from snagging or impact. In the past, a nested electrical connector assembly included a separate locking portion and alignment portion. Thus, there is a need in the art to provide a nested electrical connector assembly with an integral locking and indexing feature.

SUMMARY OF THE INVENTION

Accordingly, the present invention is an electrical connector assembly. The electrical connector assembly includes a first connector having an alignment member extending outwardly from the first connector and having an aperture extending vertically therethrough. The first connector also includes a locking mechanism disposed within the alignment member. A second connector is interconnected with the first connector and includes a connector receiving cavity for cooperatively receiving the first connector. The second connector includes an alignment channel extending vertically along an inside surface of the connector receiving cavity for cooperatively receiving the alignment member. The second connector also includes a lock stop positioned within the alignment channel for cooperatively engaging with the locking mechanism to lock the first connector into the second connector.

One advantage of the present invention is that an electrical connector assembly is provided that interconnects one electrical connector with another electrical connector. Another advantage of the present invention is that the electrical connector includes an integral alignment and locking feature. Still another advantage of the present invention is that the locking feature of the electrical connector is protected.

Other features and advantages of the present invention will be readily appreciated as the same becomes better understood after reading the subsequent description when considered in connection with the accompanying drawings.

DETAILED DESCRIPTION OF THE PRESENTLY PREFERRED EMBODIMENT

Figure 1:
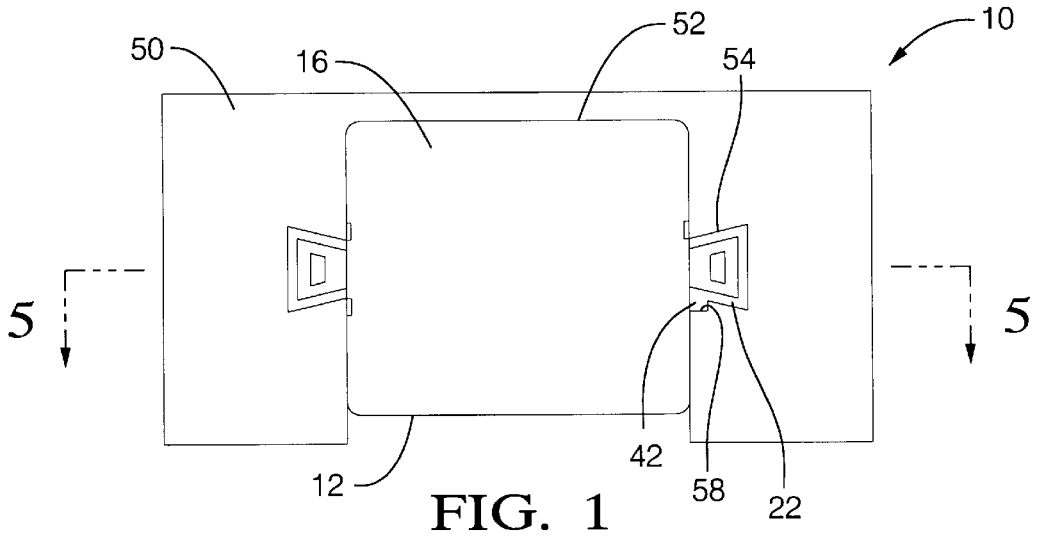
FIG. 1 is a top view of an electrical connector assembly illustrating features of the present invention.

Referring to FIG. 1, an electrical connector assembly 10 is illustrated. It should be appreciated that, in this example, the electrical connector assembly 10 is part of an electrical system on a motor vehicle (not shown), and in particular an automotive vehicle. The electrical connector assembly 10 includes a first electrical connector 12 disposed or nested within a second electrical connector 14. In this example, the first electrical connector 12 is a female thirty-two (32) way in-line connector, and the second electrical connector 14 is a female twenty (20) way in-line connector. Advantageously, interconnecting the thirty-two (32) way in-line connector with the twenty (20) way in-line connector forms a fifty-two (52) way in-line connector that can be mated with a common male fifty-two (52) way in-line connector.

Figure 2:
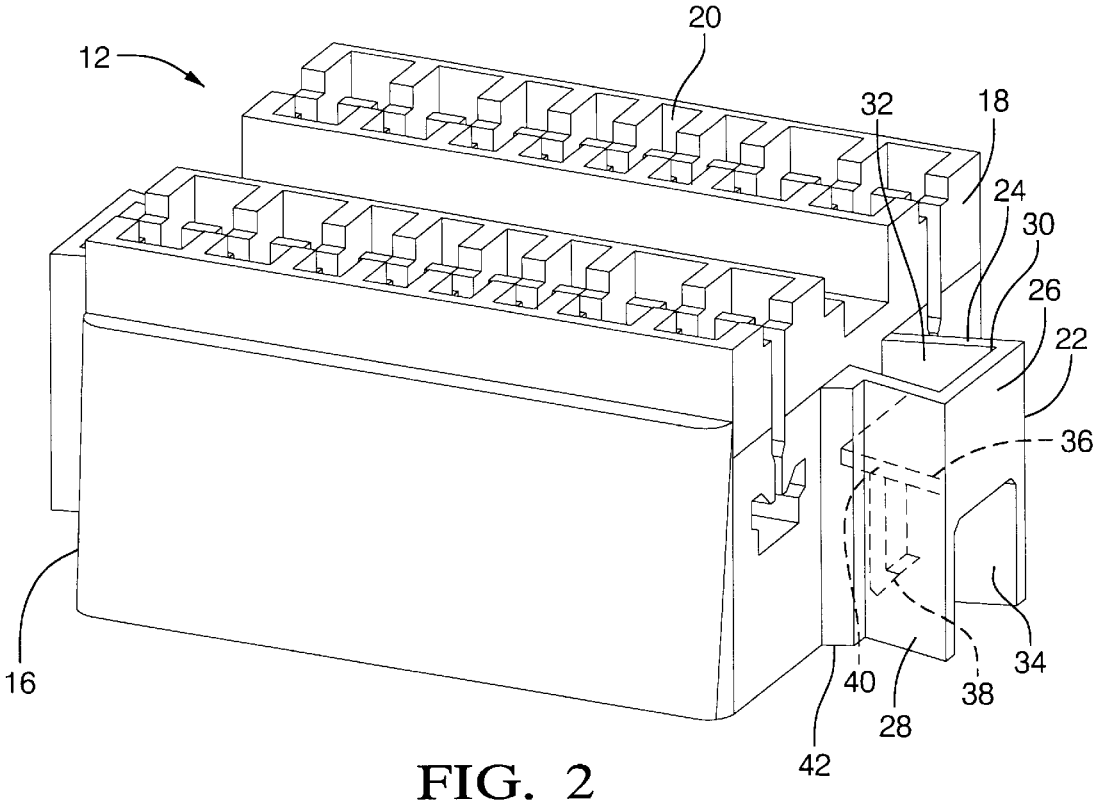
FIG. 2 is a perspective view of a male electrical connector, according to the present invention, of the electrical connector assembly of FIG. 1.

Referring to FIG. 2, the first electrical connector 12 is illustrated. The first electrical connector 12 is preferably a one-piece molded plastic member. The first electrical connector 12 includes a first body 16 having a generally rectangular shape. The first electrical connector 12 also includes a first terminal receiver portion 18. Preferably, the first terminal receiver portion 18 is positioned on a top surface of the first body 16. In this example, the first terminal receiver portion 18 is a female receiver including a plurality a cavities 20 contoured to receive and align with a corresponding male terminal from a mating connector (not shown) from another electrical device (not shown). Also, in this example, the cavities 20 are arranged in a matrix of four (4) by eight (8).

The first electrical connector 12 includes an alignment member 22 extending outwardly from a side of the first body 16. The alignment member 22 is integral and molded as one piece with the body 16. The alignment member 22 has a first wall 24 connected to a second wall 26, and a third wall 28 interconnecting the second wall 26 and first body 16. Preferably, the first wall 24, second wall 26 and third wall 28 form a male dovetail shape. Advantageously, an angle 30 between the first wall 24 and second wall 26, or second wall and third wall 28 is approximately fourteen (14) degrees to form a strong dovetail joint. The interior of the first wall 24, second wall 26 and third wall 28 includes an aperture 32 extending vertically therethrough. The second wall 26 includes a slot 34 positioned along a lower end and having a generally rectangular shape, for a function to be described.

The alignment member 22 includes a locking mechanism 36 disposed within the aperture 32 between the first wall 24, second wall 26 and third wall 28. The locking mechanism 36 includes a latch 38 cantilevered by a connecting portion 40 to the second wall 26 and extending vertically into the aperture 32. The locking mechanism 36 is integral and formed as one piece with the second wall 26. It should be appreciated that the connecting portion 40 allows the latch 38 to be flexed or deflected, for a function to be described.

The alignment member 22 also includes an alignment rib 42. The rib 42 projects outwardly and extends vertically along either one of the first wall 24, the second wall 26 or the third wall 28, to provide a positive alignment of the first electrical connector 12 with the second electrical connector 14 in a manner to be described. Preferably, the rib 42 is positioned on either one of the first wall 24 or third wall 28, along an end closest to the first body 16. The rib 42 is integral and formed as one piece with either one of the first wall 24, second wall 26 or third wall 28.

Figure 3:
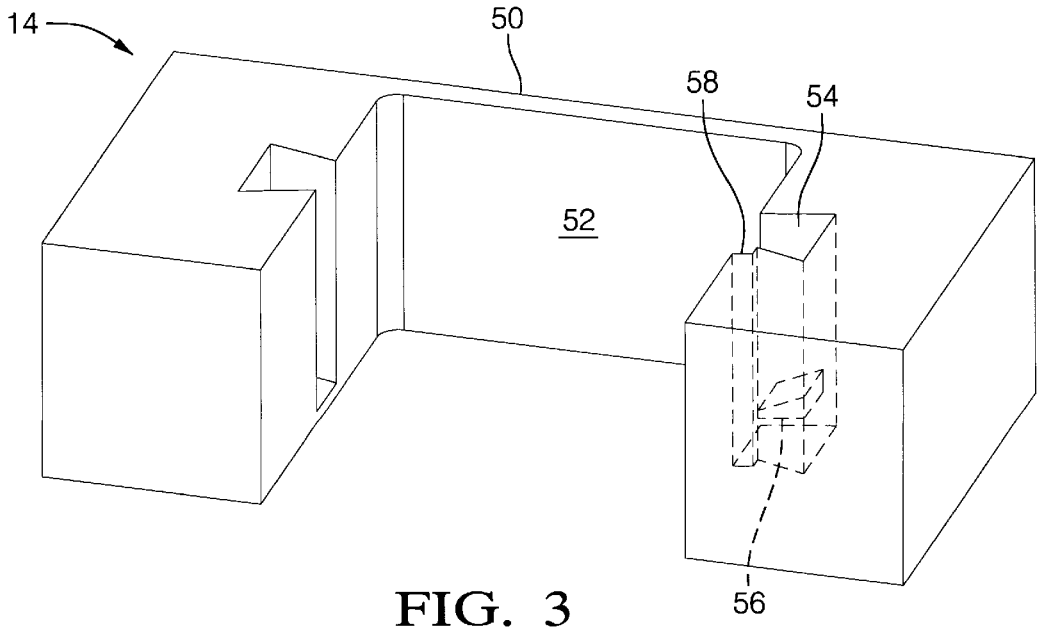
FIG. 3 is a perspective view of a female electrical connector, according to the present invention, of the electrical connector assembly of FIG. 1.

Referring to FIG. 3, a second electrical connector 14 is illustrated. The second electrical connector 14 is preferably a one-piece molded plastic member. The second electrical connector 14 includes a second body 50 having a generally rectangular shape. It should be appreciated that, in this example, the second body 50 is U-shaped. The second body 50 includes a connector receiving cavity 52 for receiving the first electrical connector 12. Preferably, the connector receiving cavity 52 corresponds in shape and contour to the first electrical connector 12, so that the first electrical connector 14 is rigidly retained within the connector receiving cavity 52 of the second electrical connector 14, in a manner to be described.

The second electrical connector 14 also includes a second terminal receiver portion (not shown), preferably positioned on a top surface of the second body 50. Preferably, the second terminal receiver portion is similar to the first terminal receiver portion 18, such as by including a plurality of cavities to receive and align with a corresponding male terminal from a mating connector from another electrical device. It should be appreciated that, in this example, the second electrical connector 14 is a twenty (20) way in-line connector as is known in the art.

The second electrical connector 14 includes an alignment channel 54. The alignment channel 54 extends vertically along an inside surface of the connector receiving cavity 52, so that the alignment channel 54 receives the alignment member 22 in a manner to be described. The alignment channel 54 corresponds in shape and contour to the alignment member 22. It should be appreciated that, in this example, the alignment channel 54 forms a female dovetail shape, as is known in the art.

The alignment channel 54 includes a lock stop 56 having a wedge shape projecting vertically from an inner surface of the alignment channel 54. The lock stop 56 is integral and formed as one-piece with the second electrical connector 14. The lock stop 56 is positioned relative to the latch 38 of the alignment member 22 in order to retain the locking mechanism 36, in a manner to be described.

The second electrical connector 14 includes an index portion 58 resembling a notch extending vertically along an inside surface of the connector receiving cavity 52. The index portion 58 is positioned relative to the alignment rib 42 of the first electrical connector 12, so as to cooperatively receive the rib 42 in a manner to be described.

Figure 4:
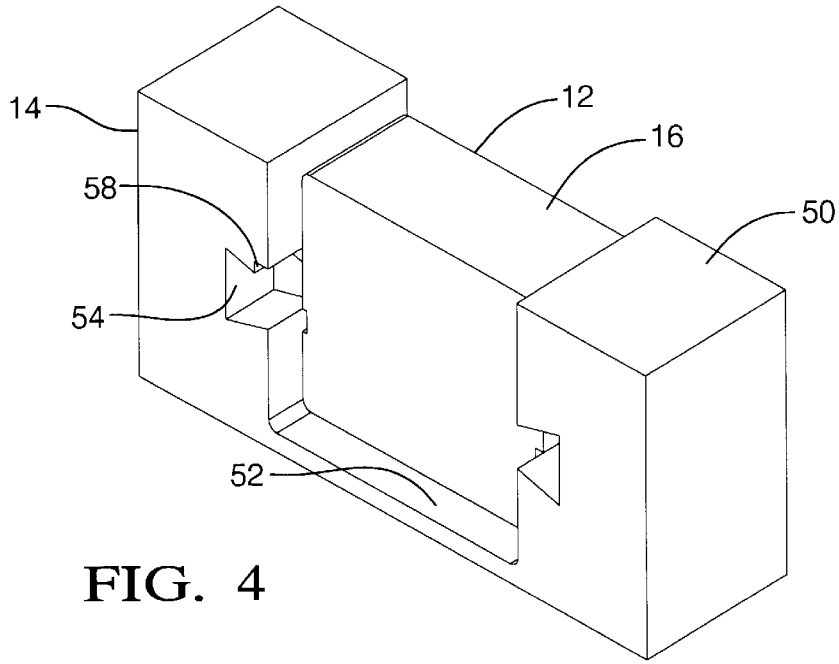
FIG. 4 is a perspective view, according to the present invention, of a first body portion nested within a second body portion for the electrical connector assembly of FIG. 1.
Figure 5:
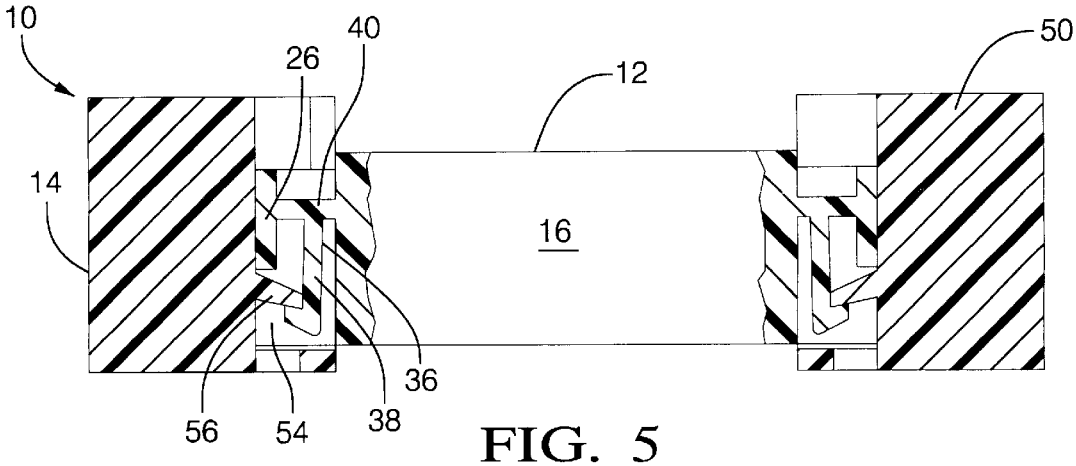
FIG. 5 is a sectional view taken along line 5—5 of FIG. 1.

Referring to FIGS. 4 and 5, the electrical connector assembly 10 is illustrated in a nested position. In operation, the alignment member 22 and alignment rib 42 of the first electrical connector 12 are aligned with the alignment channel 54 and index portion 58 of the second electrical connector 14. A downward pressure is applied to the first electrical connector 12, to slide the first electrical connector 12 into the connector receiving cavity 52 of the second electrical connector 14. The latch 38 of the locking mechanism 36 is deflected past the lock stop 56 until it assumes the final assembly position of the latch 38 under the lock stop 56. The position of the latch 38 under the lock stop 56 prevents the first electrical connector 12 from disengaging with the second electrical connector 14.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. An electrical connector assembly comprising:

a first connector;

an alignment member extending outwardly from said first connector, wherein said alignment member has an aperture extending vertically therethrough;

a locking mechanism disposed within said alignment member;

a second connector interconnected with said first connector;

a connector receiving cavity within said second connector for cooperatively receiving said first connector;

an alignment channel extending vertically along an inside surface of said connector receiving cavity for cooperatively receiving said alignment member;

a lock stop positioned within said alignment channel for cooperatively engaging with said locking mechanism to lock said first connector into said second connector.

2. An electrical connector assembly as set forth in claim 1 including an alignment rib projecting outwardly from said alignment member and extending vertically along an outer surface of said alignment member.

3. An electrical connector assembly as set forth in claim 1 wherein said locking mechanism includes a latch cantilevered by a connecting portion to said alignment member and extending vertically into said aperture within said alignment member.

4. An electrical connector assembly as set forth in claim 1 wherein said lock stop has a wedge shape and projects from an inner surface of said alignment channel relative to said latch.

5. An electrical connector assembly as set forth in claim 1 wherein said alignment member includes a first wall, a second wall and a third wall cooperatively interconnected to form a male dovetail shape.

6. An electrical connector assembly as set forth in claim 5 wherein said second wall includes a slot positioned along a lower end having a generally rectangular shape.

7. An electrical connector assembly as set forth in claim 5 wherein said alignment channel has a female dovetail shape corresponding in shape and contour to said alignment member.

8. An electrical connector assembly comprising:

a first connector;

an alignment member extending outwardly from said first connector, wherein said alignment member has an aperture extending vertically therethrough;

a locking mechanism disposed within said alignment member;

a second connector interconnected with said first connector;

a connector receiving cavity within said second connector for cooperatively receiving said first connector;

an alignment channel extending vertically along an inside surface of said connector receiving cavity for cooperatively receiving said alignment member;

a lock stop positioned within said alignment channel for cooperatively engaging with said locking mechanism to lock said first connector into said second connector;

an alignment rib projecting outwardly from said alignment member and extending vertically along an outer surface of said alignment member, and an index portion integral with said alignment channel for cooperatively receiving said alignment rib, wherein said index portion is a notch extending vertically along an inner surface of said alignment channel.

9. A nested electrical connector assembly comprising:

a first connector;

a second connector nested within said first connector;

said first connector having a first body with a first terminal receiver portion positioned on a top surface of said first body;

an alignment member having a male dovetail shape and extending outwardly from a side of said first body, wherein said alignment member has an aperture extending vertically therethrough;

a locking mechanism disposed within said alignment member, wherein said locking mechanism includes a latch cantilevered by a connecting portion to said alignment member and extending vertically into the aperture within said alignment member;

an alignment rib integral with said alignment member;

said second connector having a second body with a second terminal receiving portion positioned on a top surface of said second body;

a connector receiving cavity disposed within said second body for cooperatively receiving said first connector;

an alignment channel having a female dovetail shape extending vertically along an inside surface of said connector receiving cavity for cooperatively receiving said alignment member, wherein said alignment channel includes an index portion for cooperatively receiving said alignment rib; and a lock stop positioned within said alignment channel for cooperatively engaging with said locking mechanism to lock said first connector to said second connector.

10. A nested electrical connector assembly as set forth in claim 9 wherein said lock stop has a wedge shape projecting from an inner surface of said alignment channel relative to said latch.

11. A nested electrical connector assembly as set forth in claim 9 wherein said alignment member includes a first wall, a second wall and a third wall cooperatively interconnected to form a male dovetail shape.

12. A nested electrical connector assembly as set forth in claim 11 wherein said second wall includes a slot positioned along a lower end having a generally rectangular shape.

13. A nested electrical connector assembly as set forth in claim 11 wherein said alignment rib projects outwardly and extends vertically along an outer surface of either one of said first wall, said second wall and said third wall.

14. A nested electrical connector comprising:

a first connector, a second connector nested within said first connector;

said first connector having a first body with a first terminal receiver portion positioned on a top surface of said first body;

an alignment member having a male dovetail shape and extending outwardly from a side of said first body, wherein said alignment member has an aperture extending vertically therethrough;

a locking mechanism disposed within said alignment member, wherein said locking mechanism includes a latch cantilevered by a connecting portion to said alignment member and extending vertically into the aperture within said alignment member;

an alignment rib integral with said alignment member;

said second connector having a second body with a second terminal receiving portion positioned on a top surface of said second body;

a connector receiving cavity disposed within said second body for cooperatively receiving said first connector;

an alignment channel having a female dovetail shape extending vertically along an inside surface of said connector receiving cavity for cooperatively receiving said alignment member, wherein said alignment channel includes an index portion for cooperatively receiving said alignment rib;

a lock stop positioned within said alignment channel for cooperatively engaging with said locking mechanism to lock said first connector to said second connector;

said alignment member including a first wall, a second wall and a third wall cooperatively interconnected to form the male dovetail shape;

said alignment rib projecting outwardly and extending vertically along an outer surface of either one of said first wall, said second wall and said third wall, and said index portion being a notch extending vertically along said inner surface of said alignment channel.

15. A nested electrical connector assembly comprising:

a first connector;

a second connector nested within said first connector;

said first connector having a first body with a first terminal receiver portion positioned on a top surface of said first body;

an alignment member extending outwardly from a side of said first body, wherein said alignment member includes a first wall, a second wall and a third wall cooperatively interconnected to from a male dovetail shape and having an aperture extending therebetween said first wall, second wall and third wall;

a locking mechanism disposed within said alignment member, wherein said locking mechanism includes a latch cantilevered by a connecting portion to said second wall and extending vertically into the aperture within said alignment member;

an alignment rib integral with said alignment member, wherein said alignment rib projects outwardly and extends vertically along an outer surface of either one of said first wall, said second wall and said third wall;

said second connector having a second body with a second terminal receiving portion positioned on a top surface of said second body;

a connector receiving cavity disposed within said second body for cooperatively receiving said first connector;

an alignment channel having a female dovetail shape corresponding in shape and contour to the alignment member, extending vertically along an inside surface of said connector receiving cavity, for cooperatively receiving said alignment member;

an index portion extending vertically along an inner surface of said alignment channel for cooperatively receiving said alignment rib; and a lock stop having a wedge shape projecting from an inner surface of said alignment channel for cooperatively engaging with said locking mechanism to lock said first connector to said second connector.

16. A nested electrical connector assembly as set forth in claim 15 wherein said second wall includes a slot positioned along a lower end having a generally rectangular shape.

* * * * *